US010315075B2

(12) United States Patent
Brunette

(10) Patent No.: US 10,315,075 B2
(45) Date of Patent: Jun. 11, 2019

(54) BOWLING BALL INSERT

(71) Applicant: Brunswick Bowling Products, LLC, Muskegon, MI (US)

(72) Inventor: Roger Brunette, Bargersville, IN (US)

(73) Assignee: Brunswick Bowling Products, LLC, Muskegon, MI (US)

( * ) Notice: Subject to any disclaimer, the term of this patent is extended or adjusted under 35 U.S.C. 154(b) by 0 days.

(21) Appl. No.: 15/662,703

(22) Filed: Jul. 28, 2017

(65) Prior Publication Data

US 2018/0028868 A1 Feb. 1, 2018

Related U.S. Application Data

(60) Provisional application No. 62/368,424, filed on Jul. 29, 2016.

(51) Int. Cl.
*A63B 37/00* (2006.01)

(52) U.S. Cl.
CPC .. *A63B 37/0002* (2013.01); *A63B 2243/0054* (2013.01)

(58) Field of Classification Search
CPC .... B41J 19/40; A63B 37/001; A63B 37/0001; A63B 37/0002; A63B 2243/0054
USPC ..... 473/129, 128, 130, 61, 60, 92, 93, 98
See application file for complete search history.

(56) References Cited

U.S. PATENT DOCUMENTS 1,080,307 A 12/1913 Sondheimer
3,001,793 A 9/1961 Insetta
3,102,725 A 9/1963 Jarus
3,861,681 A 1/1975 Kelsey
3,912,355 A 10/1975 Curado et al.
4,019,953 A 4/1977 Natoli
4,247,102 A 1/1981 Seyler
4,561,654 A 12/1985 Haza
4,778,178 A 10/1988 Haza
4,892,308 A 1/1990 Gaunt
5,118,106 A 6/1992 Goldman
5,308,061 A 5/1994 Bernhardt
5,536,212 A * 7/1996 Tryon ..... A63B 37/0002 473/129
5,738,592 A * 4/1998 Saunders ..... A63B 37/0002 473/130
5,795,236 A 8/1998 Alberts et al.
5,800,276 A 9/1998 Hill
(Continued)

*Primary Examiner* — John E Simms, Jr.
*Assistant Examiner* — Rayshun K Peng
(74) *Attorney, Agent, or Firm* — Womble Bond Dickinson (US) LLP

(57) ABSTRACT

A bowling ball insert has an outer sleeve and an inner sleeve (or solid), with the outer sleeve having a pair of vertical channels that are open at the top, and a pair of horizontal channels extending perpendicularly from the vertical channels, with the two vertical channels having different widths. The inner sleeve (or solid) includes tabs that are sized to fit in the outer sleeve channels, with at least one of the tabs being sized to fit in one vertical channel but not in the other vertical channel. The outer and inner sleeves additionally include a floor that is open at the center to allow access to the ball through the insert. The inner sleeve has an upper lip to provide a controlled insert depth in the ball. The horizontal channels may include a detent to lock the inner sleeve in place after it has been inserted into and rotated within the outer sleeve.

8 Claims, 7 Drawing Sheets

(56) References Cited

U.S. PATENT DOCUMENTS

| | | | | |
|---|---|---|---|---|
| 6,126,553 | A | 10/2000 | Lakusiewicz | |
| 6,280,343 | B1 | 8/2001 | Scheid et al. | |
| 7,044,863 | B1 * | 5/2006 | Brewster | A63B 37/0002 473/129 |
| 7,048,636 | B1 * | 5/2006 | Sill | A63B 37/0002 473/129 |
| 7,074,130 | B2 | 7/2006 | Haisley | |
| 2014/0364917 | A1 * | 12/2014 | Sandstrom | A61F 2/4455 606/86 A |

* cited by examiner

BOWLING BALL INSERT

REFERENCE TO RELATED APPLICATIONS

This application claims priority from U.S. Provisional Patent Application Ser. No. 62/368,424, filed Jul. 29, 2016, the entire contents of which are hereby incorporated herein by reference.

FIELD OF THE INVENTION

The present invention relates generally to the sport of bowling, and more particularly to thumb and finger inserts for providing a customized fit and feel to the ball.

BACKGROUND TO THE INVENTION

Modern bowlers may use a variety of devices to customize the ball and provide a more predictable and successful bowling experience. Among the most popular devices are custom-drilled thumb and finger slugs and pre-drilled thumb and finger inserts. Both slugs and inserts allow the bowler to have a custom-fit hole with a consistent feel that may differ from the feel of the ball itself and can be used with a variety of balls.

Ball slugs and inserts typically include an outer sleeve portion that is permanently fixed in the ball, and an inner portion that may be temporarily locked into the ball while in use. However, existing inserts are known to not provide the fit and security desired by discriminating bowlers.

A need therefore exists for an improved bowling ball thumb or finger insert that provides improved performance when compared to existing inserts. The present invention addresses that need.

SUMMARY OF THE INVENTION

The present invention provides a bowling ball insert. One embodiment of the inventive insert comprises an outer sleeve and an inner sleeve. The outer sleeve comprises a cylindrical wall having an inner surface defining an inner circumference and an inside diameter, and an outer surface defining an outer circumference and an outside diameter, the distance between the outer surface and the inner surface preferably being constant over the length of the wall and defining an outer sleeve wall thickness, the wall having an upper end and a lower end;

the outer sleeve further having an upper lip at the upper end extending outward from the inner surface for a distance greater than the distance of the outer wall thickness;

the outer sleeve further having a floor at the lower end extending inward from the cylindrical wall around the circumference of the wall, the floor being open at its center to provide an outer sleeve floor opening having a diameter that is preferably at least one-half the inside diameter of the outer sleeve, the outer sleeve floor having a floor thickness;

wherein the inner surface of the outer sleeve wall comprises a first vertical channel that is open at the top and with a channel depth less than the thickness of the sleeve wall and with a first channel width, and a second vertical channel that is open at the top and with a channel depth less than the thickness of the sleeve wall and with a second channel width differing from the first channel width;

wherein the inner surface of the outer sleeve wall comprises a first horizontal channel having a first end open to the first vertical channel and a second end that is closed, and a second horizontal channel having a first end open to the second vertical channel and a second end that is closed.

The inner sleeve comprises a cylindrical wall having an inner surface defining an inner circumference and an inside diameter, and an outer surface defining an outer circumference and an outside diameter, the distance between the outer surface and the inner surface preferably being constant throughout the length of the sleeve and defining an inner sleeve wall thickness, the wall having an upper end and a lower end;

the inner sleeve further having a floor at the lower end extending inward from the cylindrical wall around the circumference of the wall, the floor being open at its center to provide an inner sleeve floor opening having a diameter that is preferably less than the diameter of the outer sleeve floor opening;

the inner sleeve further having a first tab having a width sized to fit in the first vertical channel and the first horizontal channel of the outer cylinder wall, and a second tab having a width sized to fit in the second vertical channel and the second horizontal channel, but not in the first vertical channel, of the outer cylinder wall, wherein the first tab and the second tab are spaced around the circumference of the inner sleeve such that when the first tab is aligned with the first vertical channel the second tab will be aligned with the second channel.

In another embodiment the outer sleeve additionally comprises a third horizontal channel, with the third horizontal channel having a first end open to the first vertical channel and a second end that is closed, and a fourth horizontal channel, with the fourth horizontal channel having a first end open to the second vertical channel and a second end that is closed. In this embodiment the inner sleeve may have a third tab having a width sized to fit in the first vertical channel and the third horizontal channel of the outer cylinder wall, and a fourth tab having a width sized to fit in the second vertical channel and the fourth horizontal channel, but not in the first vertical channel, of the outer cylinder wall, wherein the third tab and the fourth tab are spaced around the circumference of the inner sleeve such that when the third tab is aligned with the first vertical channel the fourth tab will be aligned with the second channel.

In another embodiment one or more of the horizontal channels may include a detent near its second end to mechanically resist, but not prevent, movement of an inner sleeve tab past the detent as the inner sleeve rotates within the outer sleeve in either a forward or rearward direction.

In another embodiment the inner sleeve floor has a first portion overlaying the outer sleeve floor, and a second portion extending into the outer sleeve floor opening.

WRITTEN DESCRIPTION OF THE PREFERRED EMBODIMENTS

Figure 1:
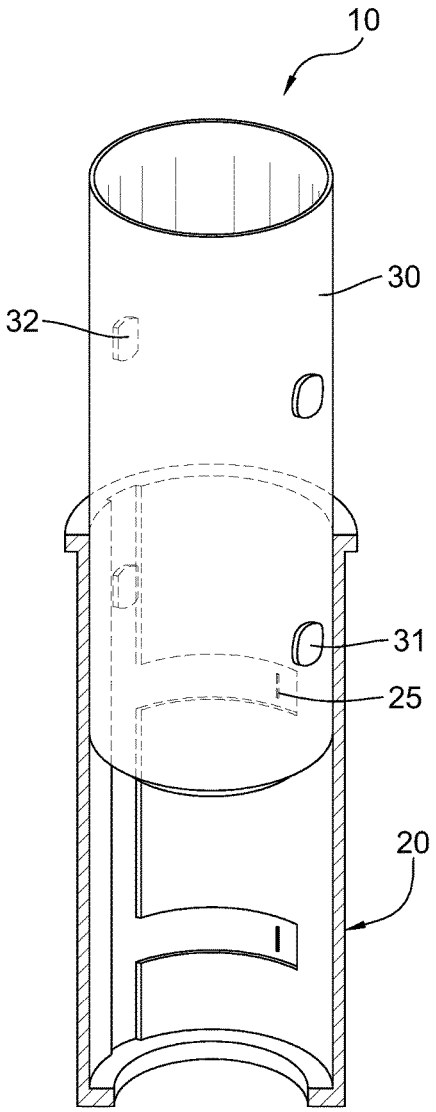
FIG. 1 is a perspective view, in partial section and in partial phantom, of one embodiment of the bowling ball insert of the present invention, showing the inner sleeve partially inserted into the outer sleeve.

For the purposes of promoting an understanding of the principles of the invention, reference will now be made to certain embodiments and specific language will be used to describe the same. It will nevertheless be understood that no limitation of the scope of the invention is thereby intended, with such alterations and modifications to the illustrated device being contemplated as would normally occur to one skilled in the art to which the invention relates.

As previously indicated, one aspect of the present invention provides a bowling ball insert comprising an outer sleeve and an inner sleeve.

The outer sleeve comprises a cylindrical wall having an inner surface defining an inner circumference and an inside diameter, and an outer surface defining an outer circumference and an outside diameter. The distance between the outer surface and the inner surface is preferably constant through the length of the sleeve, and defines the outer sleeve wall thickness. The wall has an upper end and a lower end relative to the insert when installed in a ball.

The outer sleeve preferably has an upper lip at its upper end, with the lip extending outward from the inner surface for a distance greater than the distance of the outer wall thickness. Accordingly, the upper lip extends farther outward than the sleeve wall and provides a surface for allowing the upper end of the insert to be fixedly mounted in a bowling ball, such as by gluing the lip in place.

The outer sleeve also has a floor at the lower end, with the floor extending inward from the cylindrical wall around the circumference of the wall. The floor is preferably open at its center to allow inspection of the ball below the insert. In some preferred embodiments the outer sleeve floor opening has a diameter at least one-half the inside diameter of the outer sleeve. In addition, the outer sleeve floor has a floor thickness.

The inner surface of the outer sleeve wall includes a first vertical channel that is open at the top and with a depth less than the thickness of the sleeve wall and with a first channel width, and a second vertical channel that is open at the top and with a depth less than the thickness of the sleeve wall and with a second channel width differing from the first channel width.

The inner surface of the outer sleeve wall also includes a first horizontal channel having a first end open to the first vertical channel and a second end that is closed, and a second horizontal channel having a first end open to the second vertical channel and a second end that is closed. The first horizontal channel has a first width and the second horizontal channel has a second width which may be the same as, or different from, the width of the first horizontal channel.

In the context of this description, a "vertical" channel is a channel that extends longitudinally from the top end of a sleeve toward the bottom end of that sleeve, as illustrated in the drawings. Similarly, a "horizontal" channel is a channel that extends in a direction perpendicular to a vertical channel, as illustrated in the drawings.

While the inner surface of the outer sleeve is described as being a "cylindrical" surface, it is to be appreciated that any channel portions provide discontinuities in the cylindrical surface. The remainder of the inner surface is preferably literally cylindrical, i.e., a surface with all points being a fixed and equal distance from the line defining the longitudinal axis of the sleeve.

The inner sleeve also comprises a cylindrical wall with an inner surface defining an inner circumference and an inside diameter, and an outer surface defining an outer circumference and an outside diameter. The distance between the outer surface and the inner surface is preferably uniform throughout the length of the sleeve, and accordingly defines an inner sleeve wall thickness. Like the outer sleeve, the inner sleeve wall has an upper end and a lower end relative to the insert as used.

The inner sleeve also has a floor at the lower end extending inward from the cylindrical wall around the circumference of the wall. Like the outer sleeve floor, the inner sleeve floor is preferably open at its center. Most preferably, the inner sleeve floor opening has a diameter less than the diameter of the outer sleeve floor opening, so that the floor of the inner sleeve extends into the opening of the outer sleeve. In this embodiment the inner sleeve floor has a first portion overlaying the outer sleeve floor, and a second portion extending into the outer sleeve floor opening.

The outer surface of the inner sleeve also includes a first tab with a width sized to fit and travel in the first vertical channel and the first horizontal channel of the outer cylinder wall, and a second tab with a width sized to fit and travel in the second vertical channel and the second horizontal channel. However, to ensure that the inner sleeve may only be inserted into the outer sleeve in one orientation, the second tab is sized not to fit and travel in the first vertical channel of the outer cylinder wall. The first tab and the second tab are preferably spaced around the circumference of the inner sleeve such that when the first tab is aligned with the first vertical channel the second tab will be aligned with the second channel.

While the outer surface of the inner sleeve is described as being a "cylindrical" surface, it is to be appreciated that any tab portions provide discontinuities in the cylindrical surface. The remainder of the outer surface is preferably literally cylindrical, i.e., a surface with all points being a fixed and equal distance from the line defining the longitudinal axis of the inner sleeve.

In some embodiments the outer sleeve additionally includes a second set of horizontal channels and the inner sleeve additionally includes a second set of tabs. The second set of outer tube channels may comprise another horizontal channel with a first end open to the first vertical channel and a second end that is closed (this channel being the third horizontal channel in total), and another horizontal channels have a first end open to the second vertical channel and a second end that is closed (this channel being the fourth horizontal channel in total). The second set of inner sleeve tabs may match the first set of inner sleeve tabs, with the first tab in the second set of tabs having a width that differs from the width of the second tab in the second set of tabs.

Any or all of the horizontal channels may include a detent near its second end to mechanically resist, but generally not to prevent, movement of an inner sleeve tab past the detent as the inner sleeve rotates within the outer sleeve in either a forward or rearward direction.

Referring now to the drawings, FIG. 1 is a perspective view, in partial section, of one embodiment of the bowling ball insert of the present invention, showing the inner sleeve 10 partially inserted into the outer sleeve 20. The outer sleeve includes a first vertical channel 23 into which is received an inner sleeve tab 32. The inner sleeve is being inserted into the outer sleeve after lining-up the tabs so that the tab or set of tabs with a width that matches the width of the first vertical channel is aligned with the first vertical channel, and the tabs so that the tab or set of tabs with a width that matches the width of the second vertical channel is aligned with the second vertical channel.

Figure 2:
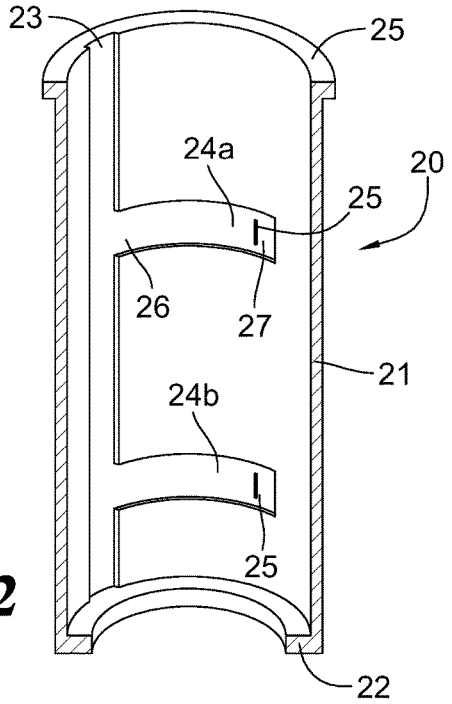
FIG. 2 is a perspective view, in partial section, of the outer sleeve of the bowling ball insert of FIG. 1.

FIG. 2 is a perspective view the outer sleeve of FIG. 1. Outer sleeve 20 includes cylindrical wall 21 with an upper lip 25 and a floor 22. Lip 25 extends outward from the inner surface for a distance greater than the distance of the outer wall thickness and provides a surface for the upper end of the insert to be fixedly mounted in a bowling ball, such as by gluing the lip in place. Vertical channel 23 has been cut in the interior surface of wall 21, and extends longitudinally downward from upper lip 23. Horizontal channels 24*a* and 24*b* have also been cut in the interior surface of wall 21, and extend in a direction perpendicular to the direction of vertical channel 23. Horizontal channel 24*a* also has a first end 26*a* open to the first vertical channel 23 and a second end 26*b* that is closed, and also includes detent 25. Detent 25 mechanically resists, but does not to completely prevent, movement of inner sleeve tab 32 past the detent as the inner sleeve rotates within the outer sleeve in either a forward or rearward direction. Also included in the illustrated outer sleeve, although not shown in this Figure, are the second vertical channel and the horizontal channels having a first end open to the second vertical channel and a second end that is closed.

Figure 3:
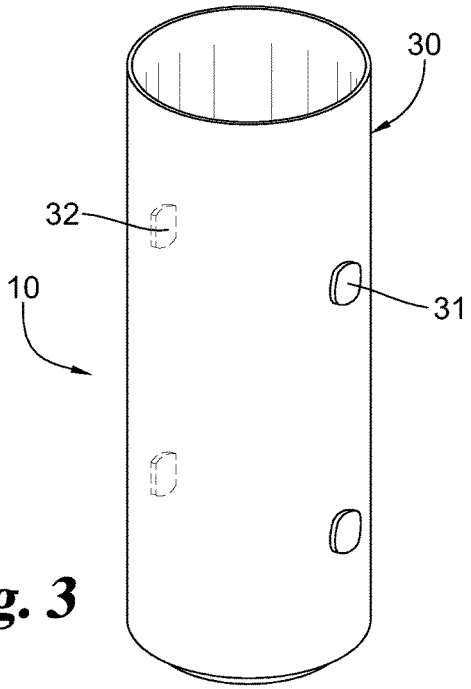
FIG. 3 is a perspective view of the inner sleeve the bowling ball insert of FIG. 1, with a second pair of tabs being shown in phantom.

FIG. 3 is a perspective view the inner sleeve of FIG. 1. Inner sleeve 30 includes a cylindrical wall having a first tab 31 or set of tabs extending outward from the wall in a first location, and a second tab 32 (shown in phantom) or set of tabs extending outward from the wall at a second location. Preferably, the first location is about 180° around the circumference of the wall from the second location, although other locations may be used as long as the vertical channels are spaced far enough apart to allow a horizontal channel to be connected to the vertical channel generally as shown and described.

Figure 4:
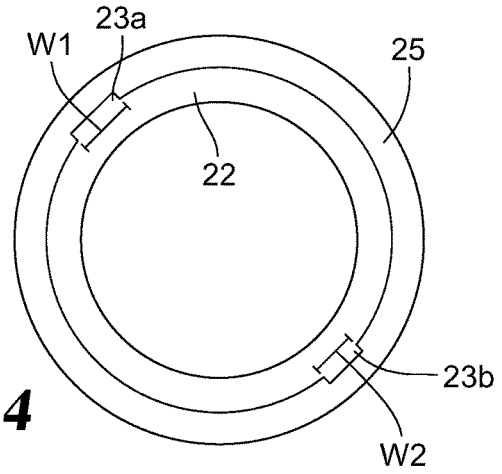
FIG. 4 is a top plan view of the outer sleeve of the bowling ball insert of FIG. 1.

FIG. 4 is a top plan view of the outer sleeve of FIG. 1. Outer sleeve wall 25 has a first vertical channel 23*a* cut in the interior of the wall at a first location, and a second vertical channel 23*b* cut in the interior of the wall at a second location. First vertical channel 23*a* has a width W1 that differs from the width W2 of second vertical channel 23*b*, with the difference being sufficient to allow a tab having a tab width approximately equal to the width of W1 to travel freely in channel 23*a*, but not to travel freely in channel 23*b*.

Outer sleeve 20 also includes a floor 22 which extends inward from the cylindrical wall around the circumference of the wall. The floor is preferably open at its center to allow inspection of the ball below the insert. In the illustrated embodiment the outer sleeve floor opening has a diameter at least one-half the inside diameter of the outer sleeve, and in the illustrated embodiment is more than ¾ the inside diameter of the outer sleeve. Outer sleeve floor 22 additionally has a floor thickness (not illustrated).

Figure 5:
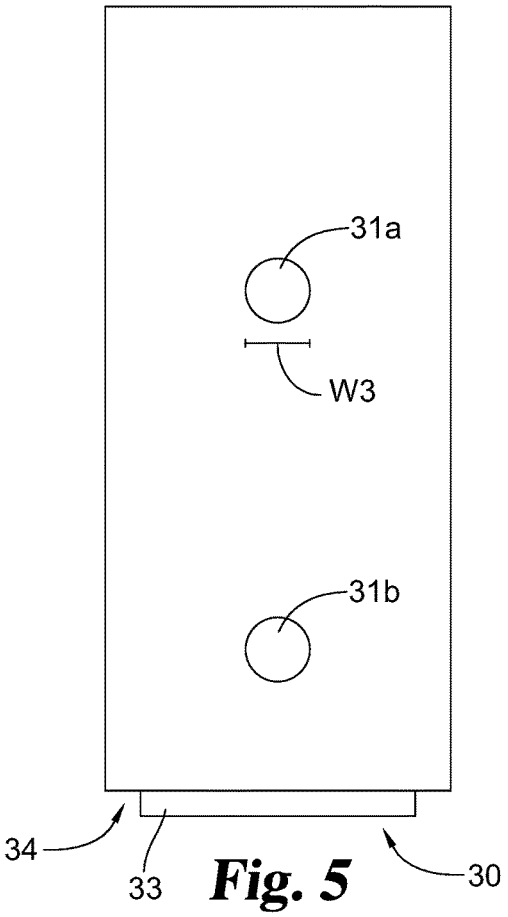
FIG. 5 is side elevational view of the inner sleeve of FIG. 1, showing the first set of tabs.

FIG. 5 is side elevational view of the inner sleeve of FIG. 1, showing the first set of tabs 31*a* and 31*b*. First tabs 31 have a width W3 that corresponds to the width of one of the vertical channels, allowing the tab(s) to slide relatively freely through the channel when properly aligned.

Figure 6:
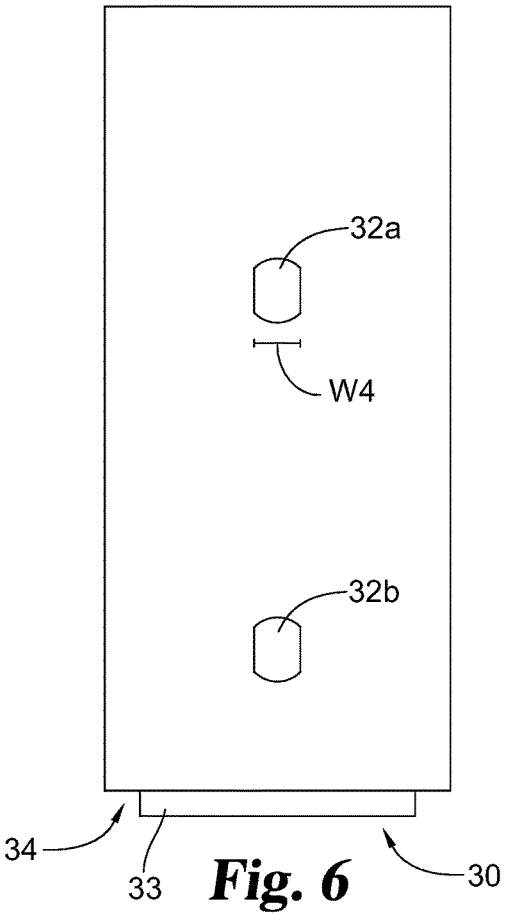
FIG. 6 is side elevational view of the inner sleeve of FIG. 1, showing a second set of tabs differing in width from the first set of tabs.

FIG. 6 is side elevational view of the inner sleeve of FIG. 1, showing the second set of tabs 32*a* and 32*b*. Second tabs 32 have a width W4 that corresponds to the width of the other of the vertical channels, allowing the tab(s) to slide relatively freely through that channel when properly aligned. As described herein, tabs 31*a* and 31*b* (shown in FIG. 5) have a width that differs from the width of tabs 32*a* and 32*b* (an in the illustrated case is wider than the width of tabs 32*a* and 32*b*), thus preventing tabs 31*a* and 31*b* from being inadvertently positioned in channel 23*b*.

Figure 7:
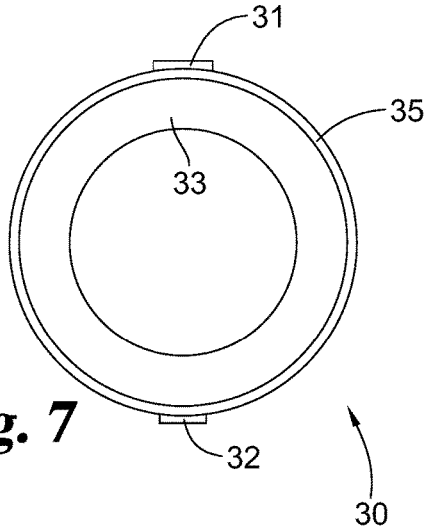
FIG. 7 is a top plan view of the inner sleeve of FIG. 1.

FIG. 7 is a top plan view of the inner sleeve of FIG. 1. Inner sleeve 30 includes a cylindrical wall 35 and a floor 33. Inner sleeve floor 33 extends inward from the cylindrical wall around the circumference of the wall. Like outer sleeve floor 22, inner sleeve floor 33 is open at its center. In the illustrated embodiment inner sleeve floor 33 has an opening with a diameter that is less than the diameter of the outer sleeve floor opening, so that inner sleeve floor 33 extends into the opening of outer sleeve 22.

Figure 8:
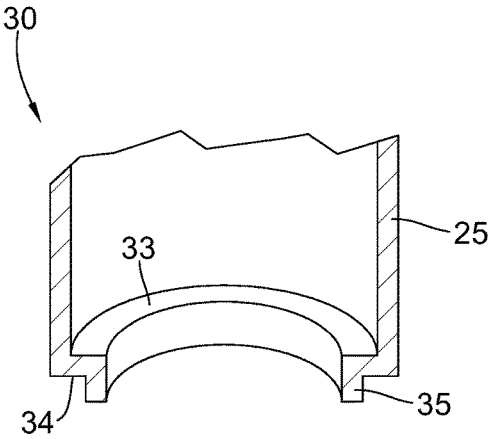
FIG. 8 is a partial section view of the lower portion of the inner sleeve of FIG. 1.

FIG. 8 is a partial section view of the lower portion of the inner sleeve of FIG. 1. Inner sleeve floor 33 extends inward from the cylindrical wall around the circumference of the wall, and includes a lower lip 35 that extends downward into the opening of outer floor 22. Accordingly, inner sleeve floor 33 has a first portion 34 overlaying the outer sleeve floor, and a second portion 35 extending into the outer sleeve floor opening.

Figure 9:
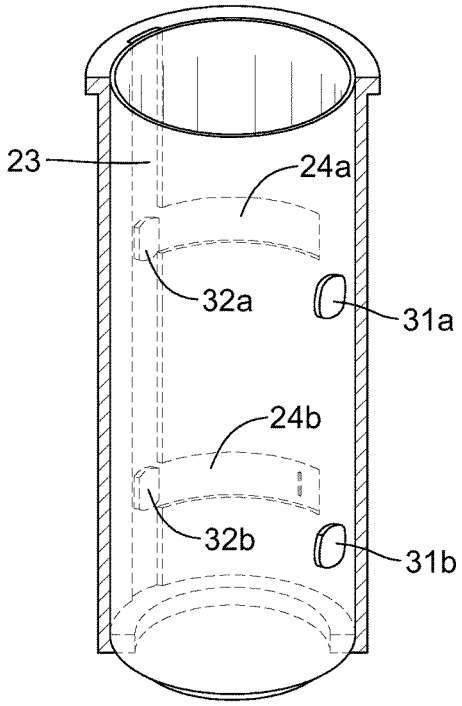
FIG. 9 is a perspective view, in partial section and in partial phantom, showing the embodiment of FIG. 1 with the inner sleeve inserted into the outer sleeve before the inner sleeve is rotated to lock the tabs in place.

FIG. 9 is a perspective view, in partial section, showing the embodiment of FIG. 1 with the inner sleeve inserted into the outer sleeve before the inner sleeve is rotated to lock the tabs in place. Inner sleeve tabs 32*a* and 32*b* have been aligned with vertical channel 23, and inner sleeve 30 has been inserted into outer sleeve 20 so that the inner sleeve tabs are aligned with the horizontal channels of the outer sleeve.

Figure 10:
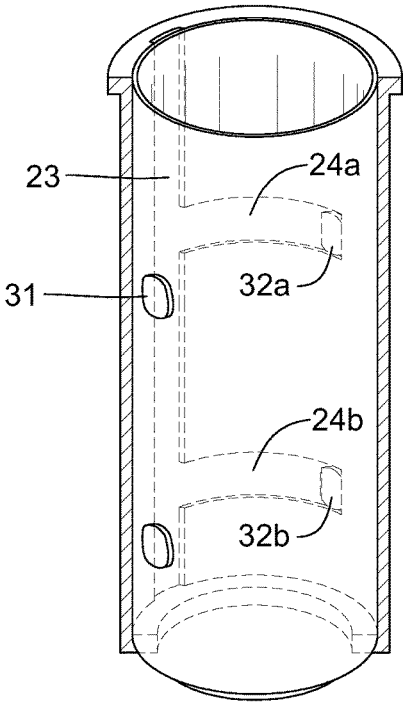
FIG. 10 is a perspective view, in partial section and in partial phantom, showing the embodiment of FIG. 1 with the inner sleeve inserted into the outer sleeve after the inner sleeve has been rotated to lock the tabs in place.

FIG. 10 is a perspective view, in partial section, showing the embodiment of FIG. 1 with the inner sleeve inserted into the outer sleeve after the inner sleeve has been rotated to lock the tabs in place. Inner sleeve tabs 32*a* and 32*b* have been rotated in horizontal channels 24*a* and 24*b* until the tabs reach the end of the channels. When a detent is included in one or both of the horizontal channels, either or both of tabs 32*a* and 32*b* are "locked" in place, although the tabs may be "unlocked" by twisting the inner sleeve in the reverse direction.

Figure 11:
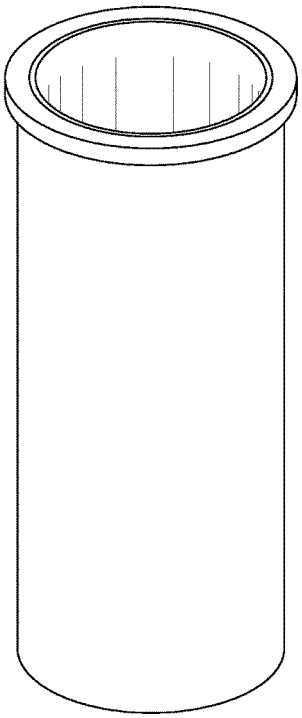
FIG. 11 is a perspective view, in partial section, showing the embodiment of FIG. 1 with the inner sleeve inserted completely into the outer sleeve.

FIG. 11 is a perspective view, in partial section, showing the embodiment of FIG. 1 with the inner sleeve inserted into the outer sleeve.

Figure 12:
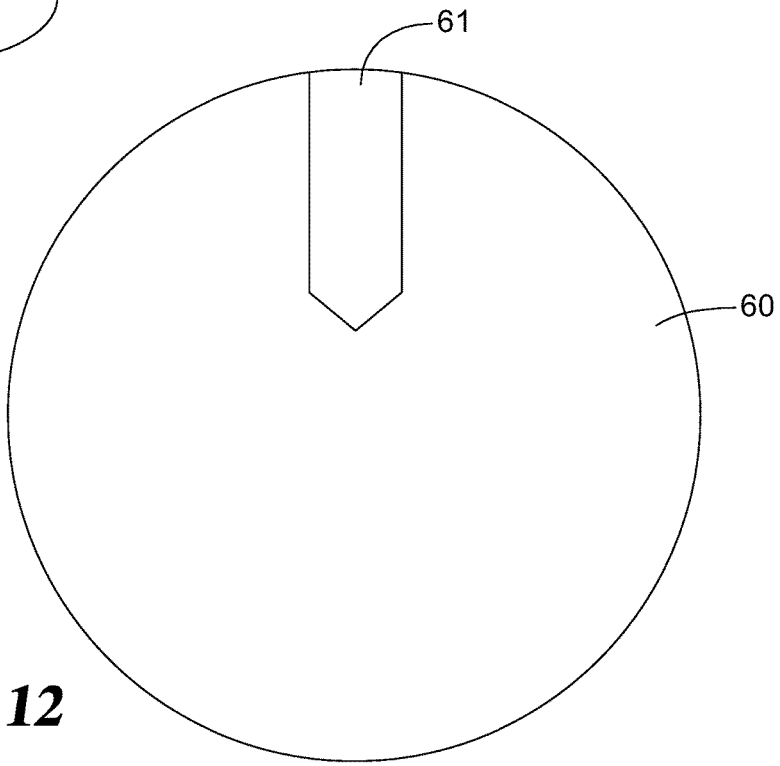
FIG. 12 is a section view of a bowling ball prepared for insertion of the bowling ball insert of the present invention.

FIG. 12 is a section view of a bowling ball prepared for insertion of the bowling ball insert of the present invention. Hole 61 is drilled in bowling ball 60 to a depth slightly longer than the length of the insert. Hole 61 has a diameter sized to snugly receive insert 10.

Figure 13:
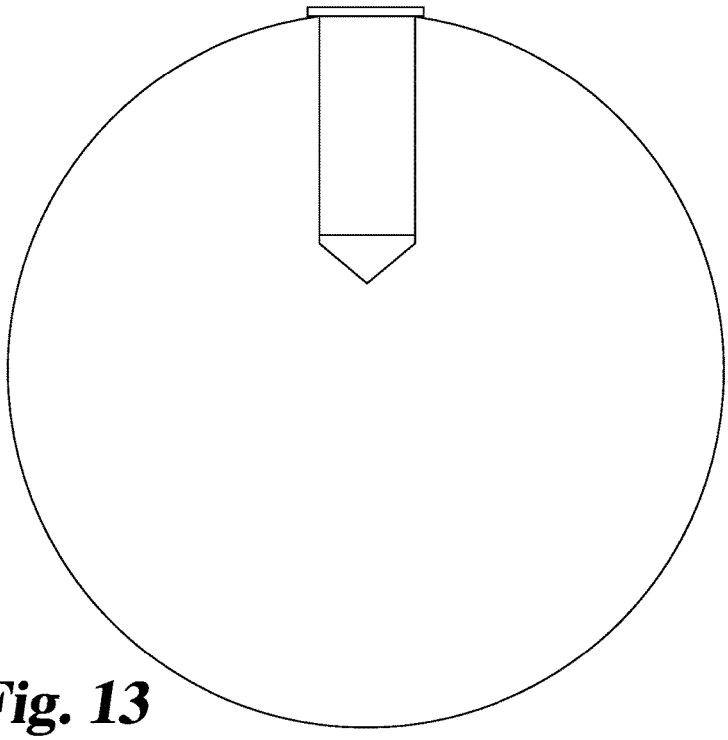
FIG. 13 is a section view of a bowling ball with the bowling ball insert of the present invention inserted into the ball with the upper lip preventing further insertion of the insert.

FIG. 13 is a section view of a bowling ball with the bowling ball insert of the present invention inserted into the ball with the upper lip preventing further insertion of the insert. The upper lip acts as a stop to prevent the insert from being inserted too far (or not far enough), thus providing a consistent length for the insert. Insert 10 is preferably glued into hole 61 to prevent the insert from moving in any direction in the hole.

Figure 14:
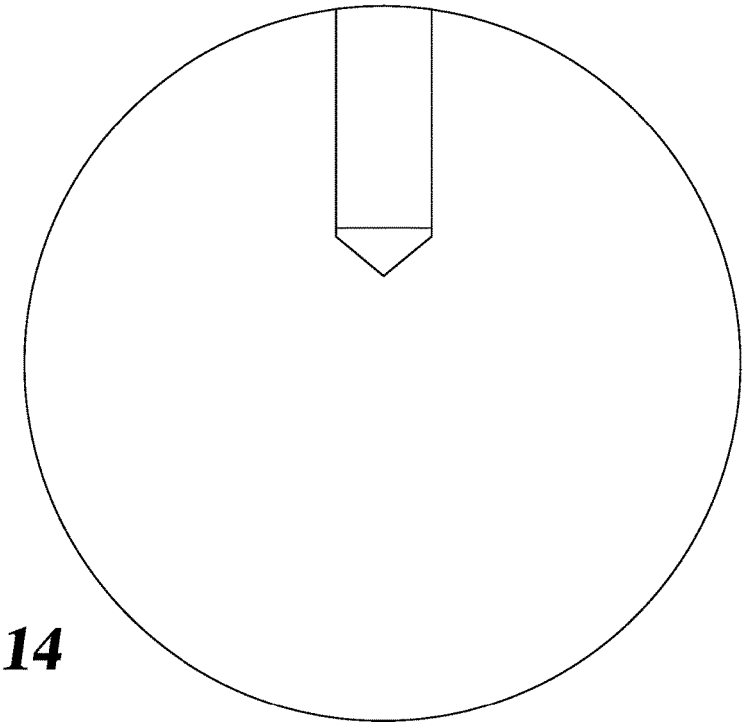
FIG. 14 is a section view of a bowling ball with the bowling ball insert of the present invention fully inserted into the ball with the upper lip removed.

FIG. 14 is a section view of a bowling ball with the bowling ball insert of the present invention fully inserted into the ball with the upper lip removed. In the illustrated embodiment the upper lip has been cut from the insert and the remaining upper surface is polished smooth with the upper surface of the ball.

Figure 15A:
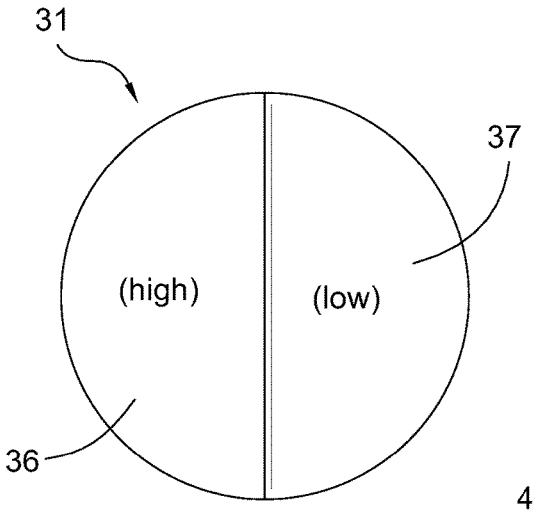
FIG. 15*a* shows one embodiment of a tab that may be provided on the inner sleeve of the bowling ball insert of the present invention.
Figure 15B:
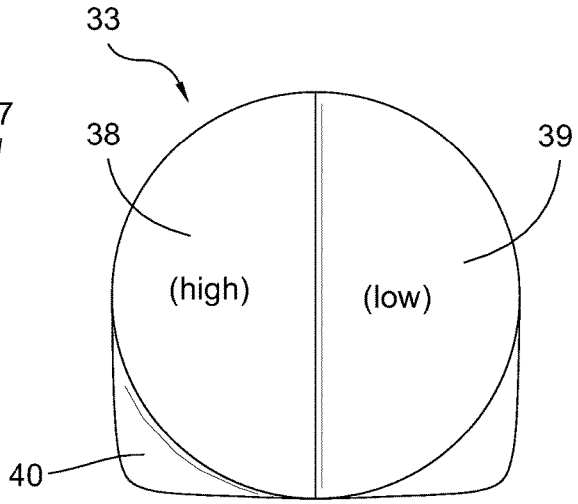
FIG. 15*b* shows another embodiment of a tab that may be provided on the inner sleeve of the bowling ball insert of the present invention, with the illustrated tab having a lower portion that that is different (wider) than the lower portion of the tab of FIG. 15*a*.

FIG. 15*a* shows one embodiment of a tab that may be provided on the inner sleeve of the bowling ball insert of the present invention. Tab 31 has a higher side 36 and a lower side 37, with the difference in height being selected to work with detent 25 to mechanically resist, but not to completely prevent, movement of the tab in the channel of the outer sleeve. This helps "lock" the inner sleeve in the outer sleeve as the detent and tab combination resists movement of the tab past the sleeve, and thus resists rotation of the inner sleeve in the outer sleeve. FIG. 15*b* shows another embodiment of a tab that may be provided on the inner sleeve of the bowling ball insert of the present invention. Tab 33 has a lower portion 40 that is not present in tab 31, making the lower portion of tab 33 different (wider) than the lower portion of the tab 31 illustrated in FIG. 15*a*. Here too, tab 33 includes a higher side 38 and a lower side 39, with the difference in height being selected to work with detent 25 to mechanically resist, but not to completely prevent, movement of the tab in the channel of the outer sleeve. The tab/detent combination mechanically resists, but does not prevent, movement of the inner sleeve tab past the detent as the inner sleeve rotates within the outer sleeve in either a forward or rearward direction, thus locking the inner sleeve in the outer sleeve when the outer sleeve in installed in a bowling ball.

Figure 16:
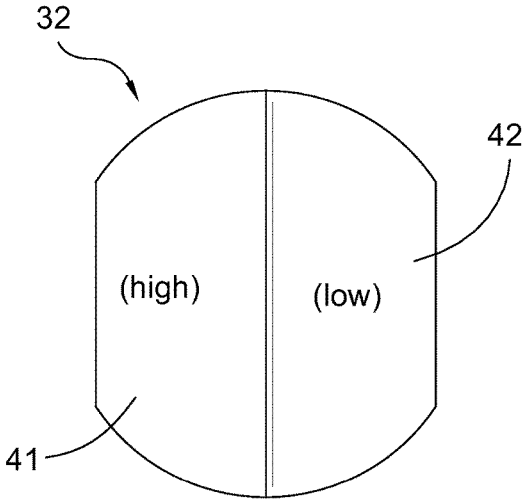
FIG. 16 shows another embodiment of a tab that may be provided on the inner sleeve of the bowling ball insert of the present invention, with the illustrated tab having a width that is different (more narrow) than the tabs of FIGS. 15*a* and 15*b*.

FIG. 16 shows another embodiment of a tab that may be provided on the inner sleeve of the bowling ball insert of the present invention, with the illustrated tab having a width that is different (more narrow) than the tabs of FIGS. 15*a* and 15*b*. Tab 32 includes a higher side 41 and a lower side 42, with the difference in height being selected to work with a detent to mechanically resist, but not to completely prevent, movement of the tab in the channel of the outer sleeve.

In another embodiment of the present invention the inner sleeve can be provided with a solid slug that is glued into the sleeve. The solid slug may then be drilled to the player's specifications, providing a more custom fit. Alternatively, the inner sleeve and solid slug may be made as a single piece combining the features otherwise provided by the inner sleeve and solid slug individually.

The "solid slug" embodiment is installed and used in the same general manner as the "sleeve alone" embodiment described above, with the exception that, typically after the outer sleeve has been installed in a ball, the inner sleeve/slug is inserted into the outer sleeve and is drilled to accept the user's thumb or finger to provide a more custom fit. To facilitate turning the inner sleeve/slug in the outer sleeve before drilling, the inner sleeve/slug is preferably sized to extend out of the outer sleeve when fully inserted so that the portion that extends above the outer sleeve may be grasped and turned to lock the inner sleeve/slug in the outer sleeve.

Figure 17:
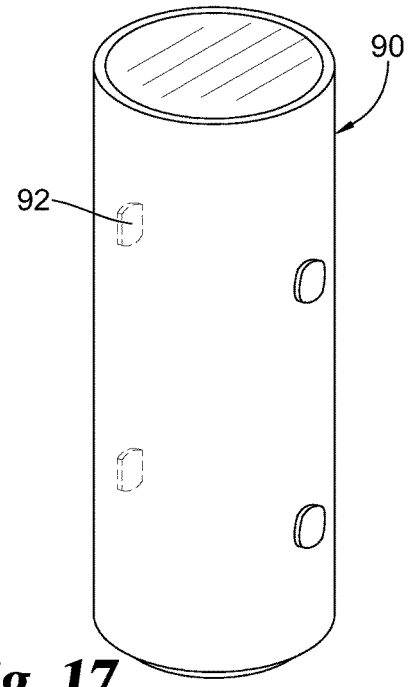
FIG. 17 is a perspective view of an inner sleeve with a solid slug inserted and glued into the sleeve.

Referring again to the drawings, FIG. 17 shows an inner sleeve and slug combination according to one embodiment of the present invention. Inner sleeve 90 includes tabs 91 and 92 as previously described, and is filled with a solid slug material 97.

Figure 18:
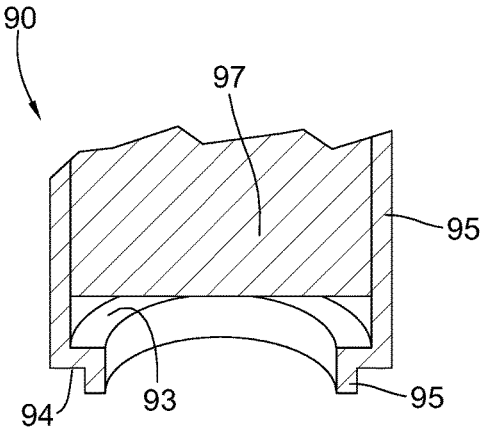
FIG. 18 is a section view of the lower portion of a solid insert used in some embodiments of the present invention.

FIG. 18 is a partial section view of the lower portion of the inner solid of FIG. 17. Floor 93 extends inward from the cylindrical wall 95 around the circumference of the wall, and includes a lower lip 98 that extends downward into the opening of outer floor 22. As with the "sleeve alone" embodiment, the floor of the inner sleeve/slug member has a first portion 94 that overlays the outer sleeve floor, and a second portion 98 extending into the outer sleeve floor opening.

Figure 19:
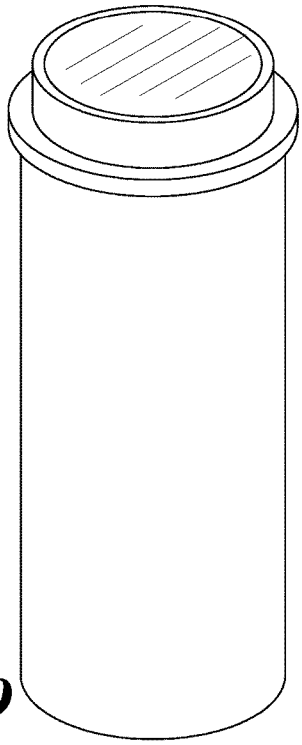
FIG. 19 is a perspective view of the "solid slug" embodiment of the bowling ball insert of the present invention, showing the inner sleeve and solid slug extending above the upper rim of the outer sleeve when the sleeve/slug is fully inserted into the outer sleeve.
Figure 20:
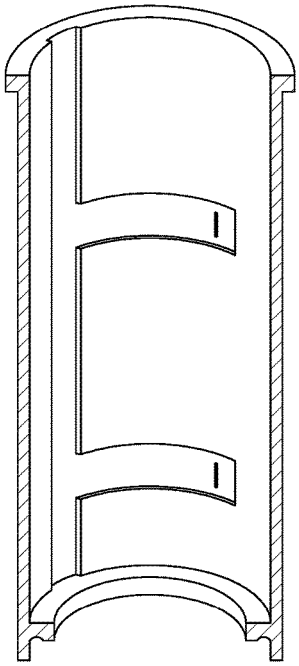
FIG. 20 shows another embodiment of the outer sleeve of the bowling ball insert of the present invention.

FIG. 19 shows the inner sleeve/solid slug inserted into an outer sleeve. As discussed above, the inner sleeve/slug is preferably sized to extend out of the outer sleeve when fully inserted so that the portion that extends above the outer sleeve may be grasped and turned to lock the inner sleeve/slug in the outer sleeve. This facilitates turning the inner sleeve/slug in the outer sleeve before drilling.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, it is to be appreciated that the present invention may comprise or consist essentially of any or all of the illustrated or described elements. Additionally, any or all of the features, elements, and/or embodiments disclosed herein may be combined with any or all of the other features, elements, and/or embodiments disclosed herein to provide a system or method that comprises or consists essentially of such features, elements, and/or embodiments.

The phrase A "and/or" B is used in this disclosure to mean A alone, or B alone, or both A and B.

The invention claimed is:

1. A bowling ball insert, comprising: an outer sleeve comprising a cylindrical wall having an inner surface defining an inner circumference and an inside diameter, and an outer surface defining an outer circumference and an outside diameter, the distance between the outer surface and the inner surface defining an outer sleeve wall thickness, said wall having an upper end and a lower end, said outer sleeve further having an upper lip at the upper end extending outward from the inner surface for a distance greater than the distance of the outer wall thickness, said outer sleeve further having a floor at the lower end extending inward from the cylindrical wall around the circumference of the wall, said floor being open at its center to provide an outer sleeve floor opening having a diameter at least one-half the inside diameter of the outer sleeve, said outer sleeve floor having a floor thickness, wherein the inner surface of the outer sleeve wall comprises a first vertical channel that is open at the top and with a depth less than the thickness of the sleeve wall and with a first channel width, and a second vertical channel that is open at the top and with a depth less than the thickness of the sleeve wall and with a second channel width differing from said first channel width, wherein the inner surface of the outer sleeve wall comprises a first horizontal channel having a first end open to the first vertical channel and a second end that is closed, and a second horizontal channel having a first end open to the second vertical channel and a second end that is closed;

and an inner sleeve comprising a cylindrical wall having an inner surface defining an inner circumference and an inside diameter, and an outer surface defining an outer circumference and an outside diameter, the distance between the outer surface and the inner surface defining an inner sleeve wall thickness, said inner sleeve having an upper end and a lower end, said inner sleeve further having a floor at the lower end extending inward from the cylindrical wall around the circumference of the wall, said floor being open at its center to provide an inner sleeve floor opening having a diameter less than the diameter of the outer sleeve floor opening, wherein said inner sleeve receives a slug material that is configured to be drilled to provide a substantially custom fit for a finger or a thumb of a user, said inner sleeve further having a first tab having a width sized to fit in the first vertical channel and the first horizontal channel, and a second tab having a width sized to fit in the second vertical channel and the second horizontal channel, but not in the first vertical channel, wherein said first tab and said second tab are spaced around the circumference of the inner sleeve such that when the first tab is aligned with the first vertical channel the second tab will be aligned with the second channel.

2. A bowling ball insert according to claim 1 wherein said outer sleeve additionally comprises a third horizontal channel, with said third horizontal channel having a first end open to the first vertical channel and a second end that is closed, and a fourth horizontal channel, with said fourth horizontal channel having a first end open to the second vertical channel and a second end that is closed.

3. A bowling ball insert according to claim 1 wherein said first horizontal channel includes a detent near its second end to mechanically resist, but not prevent, movement of an inner sleeve tab past the detent as the inner sleeve rotates within the outer sleeve in either a forward or rearward direction.

4. A bowling ball insert according to claim 3 wherein at least one of said tabs has a higher side and a lower side, with the difference in the height of the sides being adapted to allow the tab to cooperate with said detent to mechanically resist, but not prevent, movement of an inner sleeve tab past the detent as the inner sleeve rotates within the outer sleeve in either a forward or rearward direction.

5. A bowling ball insert according to claim 1 wherein said inner sleeve floor has a first portion overlaying the outer sleeve floor, and a second portion extending into the outer sleeve floor opening.

6. A method for customizing a bowling ball comprising the steps of: providing a bowling ball insert comprising an outer sleeve and an inner sleeve, wherein said outer sleeve comprises a cylindrical wall having an inner surface defining an inner circumference and an inside diameter, and an outer surface defining an outer circumference and an outside diameter, the distance between the outer surface and the inner surface defining an outer sleeve wall thickness, said wall having an upper end and a lower end, said outer sleeve further having an upper lip at the upper end extending outward from the inner surface for a distance greater than the distance of the outer wall thickness, said outer sleeve further having a floor at the lower end extending inward from the cylindrical wall around the circumference of the wall, said floor being open at its center to provide an outer sleeve floor opening having a diameter at least one-half the inside diameter of the outer sleeve, said outer sleeve floor having a floor thickness, wherein the inner surface of the outer sleeve wall comprises a first vertical channel that is open at the top and with a depth less than the thickness of the sleeve wall and with a first channel width, and a second vertical channel that is open at the top and with a depth less than the thickness of the sleeve wall and with a second channel width differing from said first channel width, wherein the inner surface of the outer sleeve wall comprises a first horizontal channel having a first end open to the first vertical channel and a second end that is closed, and a second horizontal channel having a first end open to the second vertical channel and a second end that is closed, wherein said inner sleeve comprises a cylindrical wall having an inner surface defining an inner circumference and an inside diameter, and an outer surface defining an outer circumference and an outside diameter, the distance between the outer surface and the inner surface defining an inner sleeve wall thickness, said wall having an upper end and a lower end, wherein said inner sleeve receives a slug material that is configured to be drilled to provide a substantially custom fit for a finger or a thumb of a user, said inner sleeve further having a floor at the lower end extending inward from the cylindrical wall around the circumference of the wall, said floor being open at its center to provide an inner sleeve floor opening having a diameter less than the diameter of the outer sleeve floor opening, said inner sleeve further having a first tab having a width sized to fit in the first vertical channel and the first horizontal channel, and a second tab having a width sized to fit in the second vertical channel and the second horizontal channel, but not in the first vertical channel, wherein said first tab and said second tab are spaced around the circumference of the inner sleeve such that when the first tab is aligned with the first vertical channel the second tab will be aligned with the second channel;

drilling a hole in a bowling ball, said hole having a diameter approximately equal to the outside diameter of the outer sleeve, positioning said bowling ball insert in the hole so that a bottom portion of the upper lip is flush with the surface of the ball;

and removing the upper lip from said bowling ball insert.

7. A bowling ball insert, comprising:

an outer sleeve comprising a cylindrical wall having an inner surface defining an inner circumference and an inside diameter, and an outer surface defining an outer circumference and an outside diameter, the distance between the outer surface and the inner surface defining an outer sleeve wall thickness, said wall having an upper end and a lower end, said outer sleeve further having an upper lip at the upper end extending outward from the inner surface for a distance greater than the distance of the outer wall thickness, said outer sleeve further having a floor at the lower end extending inward from the cylindrical wall around the circumference of the wall, said floor being open at its center to provide an outer sleeve floor opening having a diameter at least one-half the inside diameter of the outer sleeve, said outer sleeve floor having a floor thickness, wherein the inner surface of the outer sleeve wall comprises a first vertical channel that is open at the top and with a depth less than the thickness of the sleeve wall and with a first channel width, and a second vertical channel that is open at the top and with a depth less than the thickness of the sleeve wall and with a second channel width differing from said first channel width, wherein the inner surface of the outer sleeve wall comprises a first horizontal channel having a first end open to the first vertical channel and a second end that is closed, and a second horizontal channel having a first end open to the second vertical channel and a second end that is closed;

an inner sleeve comprising a cylinder having an outer surface and a diameter, wherein said inner sleeve receives a slug that is configured to be drilled to provide a substantially custom fit for a finger or a thumb of a user, said inner sleeve further having a floor at its lower end extending inward from the outer surface of the cylinder, said floor being open at its center to provide an inner sleeve floor opening having a diameter less than the diameter of the outer sleeve floor opening, said inner solid sleeve further having a first tab having a width sized to fit in the first vertical channel and the first horizontal channel, and a second tab having a width sized to fit in the second vertical channel and the second horizontal channel, but not in the first vertical channel, wherein said first tab and said second tab are spaced around the circumference of the inner sleeve such that when the first tab is aligned with the first vertical channel the second tab will be aligned with the second channel; and a detent positioned along a surface of said first horizontal channel or a surface of said second horizontal channel, and configured to mechanically resist movement of said first tab along said first horizontal channel or said second tab along said second horizontal channel when the inner sleeve is rotated within the outer sleeve in at least one direction.

8. The bowling ball insert of claim 7, wherein said first tab or said second tab includes a higher side and a lower side, and wherein a difference in height between the higher side and the lower side is selected to work with the detent to mechanically resist, but not to completely prevent, movement of said first tab along said first horizontal channel or said second tab along said second horizontal channel to help to lock and resist rotation of said inner sleeve in relation to said outer sleeve.

* * * * *